United States Patent [19]

Eschmann et al.

[11] Patent Number: 4,877,013

[45] Date of Patent: Oct. 31, 1989

[54] HOT BLAST STOVE INSTALLATION

[75] Inventors: Friedrich Eschmann, Bischofsheim; Christian Streuber, Wiesbaden-Auringen, both of Fed. Rep. of Germany

[73] Assignee: Didier-Werke AG, Wiesbaden, Fed. Rep. of Germany

[21] Appl. No.: 131,719

[22] Filed: Dec. 11, 1987

[30] Foreign Application Priority Data

Jul. 31, 1987 [DE] Fed. Rep. of Germany ..... 3725450

[51] Int. Cl.[4] ..... F24H 3/02

[52] U.S. Cl. ..... 126/110; 432/29; 432/30; 432/40

[58] Field of Search ..... 126/110; 432/40, 30, 432/216, 217, 29

[56] References Cited

U.S. PATENT DOCUMENTS 1,316,086 9/1919 Dovel ..... 432/40 X
3,284,070 11/1966 Nishida et al. ..... 432/40
4,452,586 6/1984 Voges ..... 432/40 X

FOREIGN PATENT DOCUMENTS 2643393 3/1978 Fed. Rep. of Germany ..... 432/40
3126494 1/1983 Fed. Rep. of Germany .

*Primary Examiner*—Larry Jones
*Attorney, Agent, or Firm*—Wenderoth, Lind & Ponack

[57] ABSTRACT

A hot blast stove installation for heating cold blast to form hot blast includes a plurality of hot blast stoves each alternately operable during a heating phase and a blowing phase, a cold blast main for supplying cold blast to respective of the stoves during the blowing phases thereof, and combustion air and fuel gas mains for supplying combustion air and fuel gas to respective of the stoves during the heating phases thereof. The cold blast in the cold blast main has a relatively high temperature compared to ambient temperature, for example a temperature of from 100° C. to 300° C. A heat exchanger is connected to the cold blast main to remove heat from the cold blast therein prior to the supply of the cold blast to the stoves, thereby reducing the men and/or maximum waste gas temperature in the stoves during the heating phase of operation thereof.

12 Claims, 4 Drawing Sheets

HOT BLAST STOVE INSTALLATION

BACKGROUND OF THE INVENTION

The present invention relates to a hot blast stove installation for heating cold blast to form hot blast and of the type including a plurality of hot blast stoves each alternately operable during a heating phase and a blowing phase and a cold blast main for supplying cold blast to respective of the stoves during the blowing phases thereof. The present invention particularly is directed to such a hot blast stove installation of the type wherein the temperature of the cold blast in the cold blast main is relatively high compared to ambient temperature, for example between 100° C. and 300° C.

Such a hot blast stove installation is disclosed in DE-PS No. 3,126,494, wherein cold blast at such relatively high temperature is fed alternately to the plurality of hot blast stoves during the blowing periods or phases of operation thereof. During heating periods or phases of operation of the respective stoves combustion occurs in the stoves by the supply thereto of combustion air and fuel gas. The waste gas temperature resulting from such combustion can only be so high due to limitations of the structure, particularly the brick work structure of the stoves. This imparts an inherent limitation to the extent of combustion that can be achieved during the heating phase. When the temperature of the cold blast supplied to the stoves during the respective blowing periods is relatively high, this will lead to a relatively high mean and maximum waste gas or exhaust gas temperature during the heating periods or phases of operation. This results in an inherent limitation in the output of the hot blast stove installation.

In DE-PS No. 3,126,494, a heat exchanger circuit is connected on a primary side thereof to the exhaust gas or flue gas collecting main of the hot blast stove installation. As a result, although the waste heat of the waste or flue gas is used for preheating the combustion air and/or the fuel gas, there still results the above discussed disadvantage resulting from the relatively high temperature of the cold blast. Particularly, there results the above discussed limitation on the overall power of heat output of the stoves and the installation.

SUMMARY OF THE INVENTION

With the above discussion in mind, it is an object of the present invention to provide an improved hot blast stove installation of the above type, but wherein it is possible to overcome the above discussed and other prior art disadvantages.

It is a more specific object of the present invention to provide such an improved hot blast stove installation whereby it is possible to avoid the disadvantageous effects of a relatively high temperature of the cold blast.

These objects are achieved in accordance with the present invention by the provision of means for reducing the temperature of the cold blast from the cold blast main prior to the supply of the cold blast to the stoves. As a result, it is possible to reduce the mean or maximum temperature of the waste gas within the stoves during the heating phases of operation thereof, thereby making it possible to increase the extent of heating and thereby increase the output of the installation.

The heat removed from the cold blast can be utilized at any desired position of utilization, but in a particularly preferred arrangement the heat removed from the cold blast is used to preheat the combustion air and/or the fuel gas prior to the supply thereof to the hot blast stoves during the heating phases of operation thereof.

In accordance with the present invention, the relatively high temperature of the cold blast, which is advantageous with regard to energy savings of the overall installation, is not utilized directly by feeding the relatively hot cold blast to the hot blast stoves during the blowing phases of operation thereof. Rather, the heat from the relatively hot cold blast is employed indirectly by supplying such heat to the combustion air and/or the fuel gas of the other hot blast stove or stoves during the heating phases of operation thereof. As a result, the mean and/or maximum waste or exhaust gas temperature in the hot blast stoves, which operate alternately as heated and cooled regenerators, is lowered. By lowering the maximum waste gas temperature that occurs, the temperature allowed for the particular hot blast stove design will be reached only in the case of a relatively high hot blast stove output. As a result, it is possible to increase to the highest possible extent the output of the hot blast stoves and of the overall installation.

In order to adapt the preheating of the combustion air and/or of the fuel gas to particular requirements, in one advantageous arrangement of the present invention it is possible to provide means for supplying supplemental heat to the heat exchange circuit which supplies the heat removed from the cold blast to the combustion air and/or fuel gas. In a modification of this arrangement, the supplemental heat is taken from the waste or exhaust gas from the hot blast stoves. In this manner, the still usable heat of the waste gas can be used to preheat the combustion air and/or fuel gas.

BRIEF DESCRIPTION OF THE DRAWINGS

Other objects, features and advantages of the present invention will become apparent from the following detailed description of preferred embodiments thereof, taken with the accompanying drawings, wherein.

DETAILED DESCRIPTION OF THE INVENTION

Figure 1:
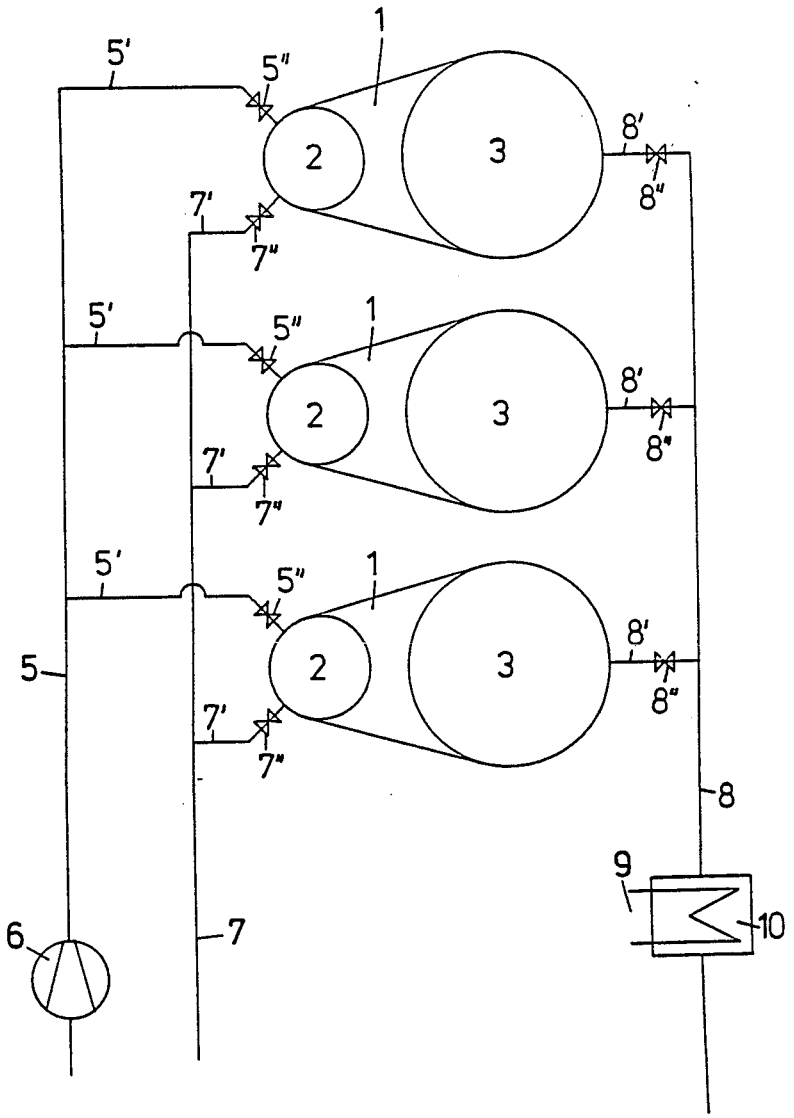
FIG. 1 is a schematic illustration of a hot blast stove installation according to the present invention and particularly illustrating a heat exchanger provided in a cold blast main.

FIG. 1 schematically illustrates a hot blast stove installation employable for continuous operation and including a plurality, for example three, of hot blast stoves 1. Each hot blast stove 1 includes a combustion chamber 2 and a regenerative or heat storage chamber 3 connected thereto. Within the regenerative chamber 3 are disposed storage or checker bricks and supporting them a grate which must not be exposed to temperatures higher than about 350° C. to 400° C.

A combustion air main 5 is connected via branch lines 5' to each of the combustion chambers 2, and a blower 6 is mounted in combustion air main 5. Further, a combustible or fuel gas main 7 is connected via branch lines 7' to each of the combustion chambers 2.

A cold blast main 8 is connected via branch lines 8' to hot blast stoves 1. In FIG. 1, the exhaust or waste gas main leading to a stack is not illustrated, and furthermore in the present arrangement the hot blast main leading from the stoves to a position of utilization, for example a blast furnace, is not shown. The arrangement of such features is intended to be entirely conventional and readily would be understood by one skilled in the art.

In the branch lines 5', 7', 8' are provided respective shut-off valves 5'', 7'', 8'' which are employed to control the alternate operation of the plurality of hot blast stoves 1 during the respective heating and blowing periods or phases of operation thereof. During the heating phase of operation of each hot blast stove 1, the respective shut-off valves 5'', 7'' thereof are open, and the respective shut-off valve 8'' thereof is closed. During such heating phase, combustion occurs in the respective combustion chamber 2 and the heat resulting therefrom is stored in the respective regenerative chamber 3 while exhaust or waste gases are discharged. During a subsequent blowing period or phase of operation of such hot blast stove 1, the shut-off valve 8'' is opened and the shut-off valves 5'', 7'' are closed. Cold blast is supplied from main 8 through respective branch line 8' into the stove 1, such cold blast is heated by the stored heat therein to form hot blast, and such hot blast is discharged from the stove to a position of utilization in a known manner. The heating and blowing periods or phases of operation of the respective stoves are alternated in an adjustable manner to control the overall output of the installation.

In such an arrangement, if the temperature of the cold blast is relatively high, then this will result in an elevated mean and/or maximum exhaust gas temperature, and this will inherently limit the output of the stove and therefore of the overall installation. In accordance with the present invention, this disadvantage is avoided by the provision of means for reducing the temperature of the cold blast from the cold blast main 8 prior to the supply thereof to the respective stoves 1. Thus, as shown in FIG. 1, a heat exchanger 10 is connected to cold blast main 8 to remove heat from the cold blast supplied therethrough. Such removed heat may be supplied to a suitable position of utilization by a heat exchanger loop or circuit 9.

Figure 2:
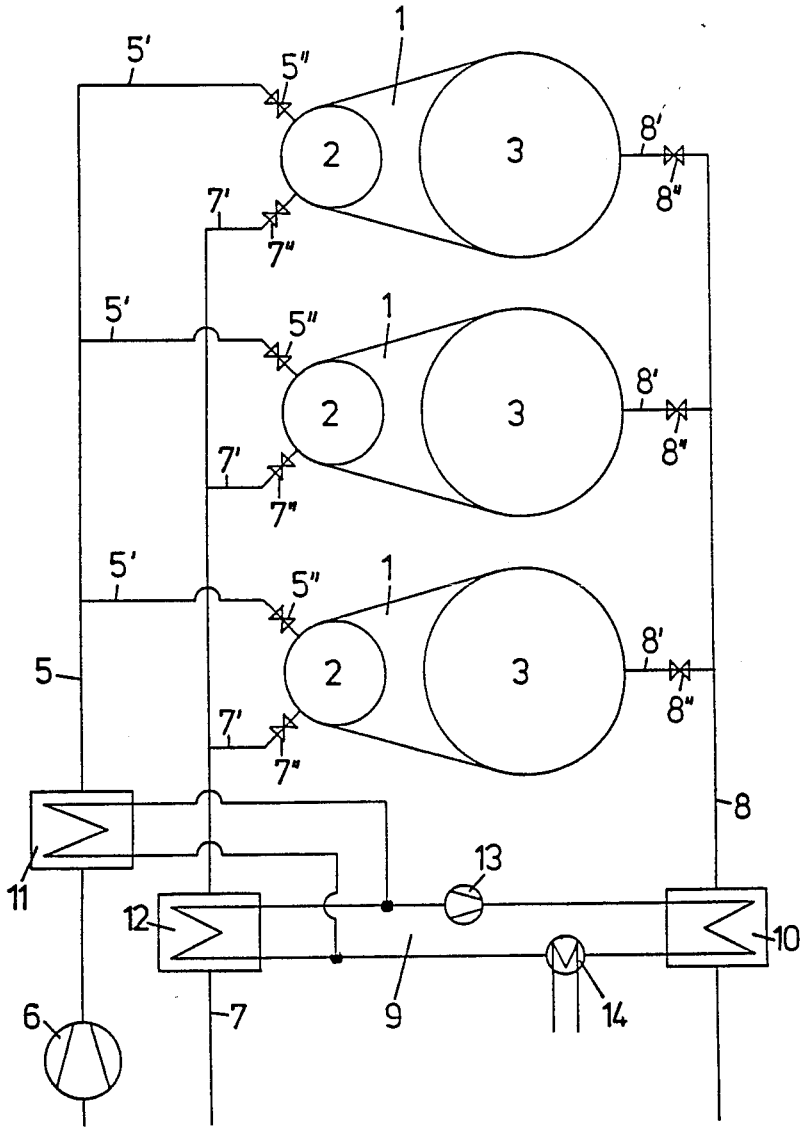
FIG. 2 is a view similar to FIG. 1 but illustrating a heat exchange circuit between the cold blast main and mains for supplying combustion air and fuel gas, and additionally illustrating the supply of supplemental heat.

FIG. 2 illustrates a particularly advantageous arrangement of the present invention wherein circuit 9 leads to a heat exchanger 11 connected to combustion air main 5 and to a heat exchanger 12 connected to fuel gas main 7. From the viewpoint of fluid mechanics, heat exchangers 11, 12 may be connected in parallel or in series. A recirculating pump 13 is mounted in heat exchanger circuit 9 to pump therethrough a suitable heat exchange fluid, for example oil or water. Thus, heat exchanger 10 removes heat from the cold blast supplied through main 8, and this removed heat is transferred to the combustion air and/or fuel gas by the heat exchange fluid passing through respective heat exchangers 11 and/or 12.

It is to be understood however that it would be possible in accordance with the present invention to provide direct heat exchange between cold blast main 8 and combustion air main 5 and/or fuel gas main 7, or to achieve heat transfer by any other suitable heat absorbing medium.

If necessary and/or desirable, heat exchanger circuit 9 can be supplied with supplemental heat by an additional heat exchanger 14 which may supply the supplemental heat from any suitable source. For example, the supplemental heat could be removed from the waste or exhaust gas from the stoves and supplied to the heat exchange fluid in circuit 9.

The manner of operation of the hot blast stove installation described above is approximately as follows.

Thus, cold blast, at a counter pressure dependent upon the mode of operation of the position of utilization of the hot blast, for example a blast furnace, and compressed to a suitable pressure, for example 2.5 to 10 bar, and at a temperature of 100° C. to 300° C., for example 200° C., is supplied through cold blast main 8. On the primary side of heat exchanger 10 heat is removed from the cold blast so that the thus cooled cold blast is fed to the particular hot blast stove 1 at a temperature lowered by approximately 100° K, or 100° C. in this example. This removed heat is transferred via heat exchanger 12 to the fuel gas in main 7, the temperature of which thereby is raised to, for example, 130° C. Similarly, the temperature of the combustion air may be raised by heat exchanger 11 to, for example, approximately 140° C. The hot blast stove or stoves 1 switched to the heating phase thereby are supplied with preheated combustion air and/or preheated fuel gas. Since the hot blast stove switched to the heating phase previously had been supplied with a relatively cool cold blast, for example at a temperature of 100° C. in this example, the waste gas temperature resulting from combustion during the heating phase will not exceed values allowed for the particular brick work design. With identical hot blast stove outlets, the mean waste gas temperature is, for example, around 190° C., and the maximum waste gas temperature is, for example, around 240° C. Thus, the hot blast stove output can be increased significantly by lowering of the waste gas temperatures. In other words, more combustion is possible during the heating phase, since the waste gas temperature which heats the checker bricks is reduced by the previous cooling by the relatively cool cold blast during the previous blowing period. The heating of the regenerative chamber 3 of the hot blast stove 1 will ensure that the cold blast will be heated to the required hot blast temperature during a subsequent blowing phase of operation of the stove.

Other practical embodiments than described above are possible within the scope of the present invention. For example, it would be possible to provide upstream of each hot blast stove 1 a separate heat exchanger 11 in each respective branch line 5' and/or a separate heat exchanger 12 in each respective branch line 7'. This would be of particular advantage if a separate blower 6 is installed upstream for each hot blast stove 1.

Figure 3:
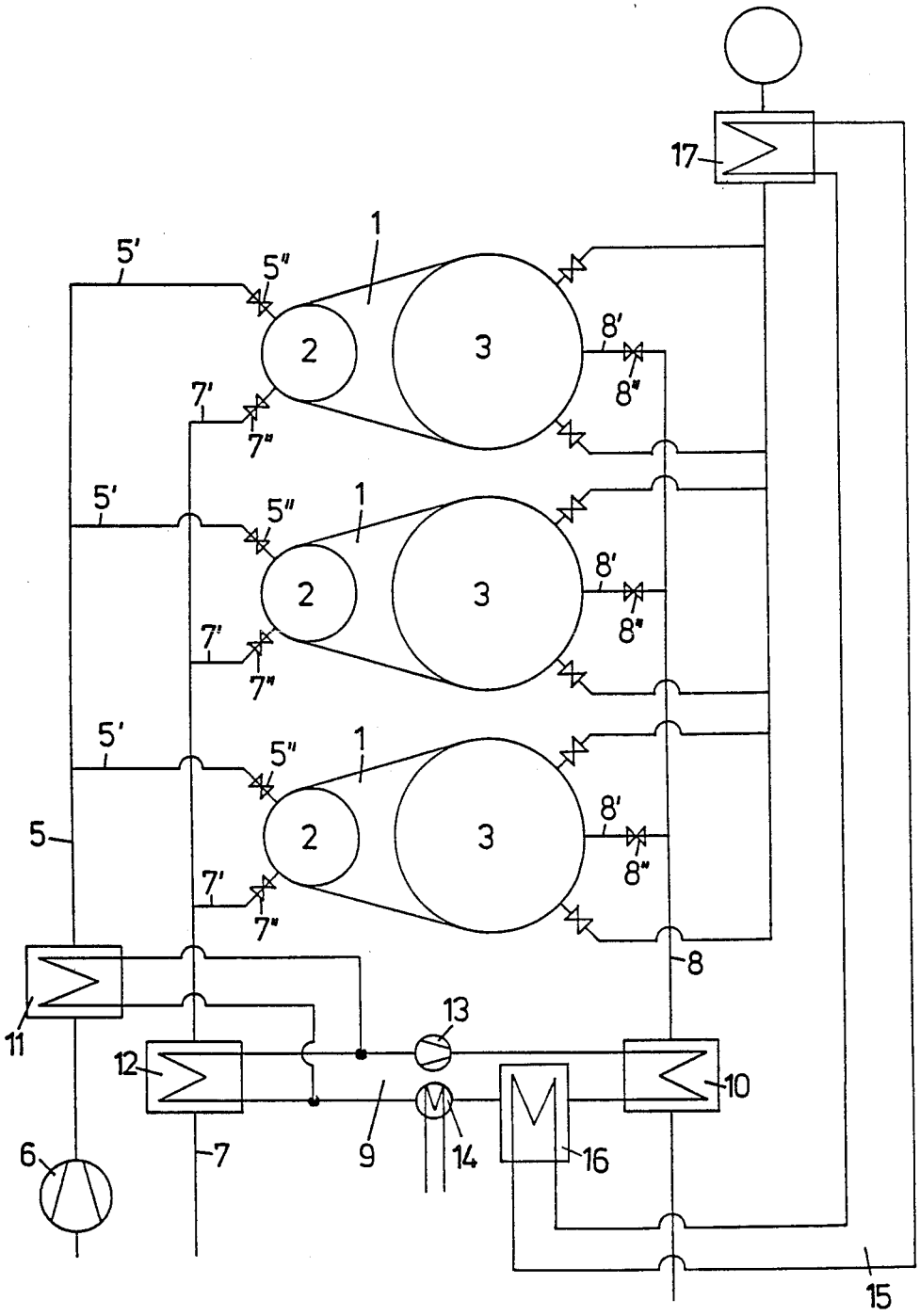
FIG. 3 is a view similar to FIG. 2 but additionally illustrating the supply of supplemental heat from waste gas from the stoves.

FIG. 3 shows an addition to the arrangement of FIG. 2, and specifically wherein heat from the waste gas from the stoves is employed to supply additional heat to circuit 9. Thus, during the heating phase of the operation of each stove the exhaust or waste gas is discharged from the stove to a stack. Upstream of such stack is provided an additional heat exchanger 17 which is connected by an additional circuit 15 to a further heat exchanger 16 connected to circuit 9. Thus, heat is removed from the waste gas being supplied to the stack and is transferred to the heat exchange fluid in circuit 9, and such heat then subsequently is transferred to the combustion air in main 5 by heat exchanger 11 and/or to the fuel gas in main 7 by heat exchanger 12.

Figure 4:
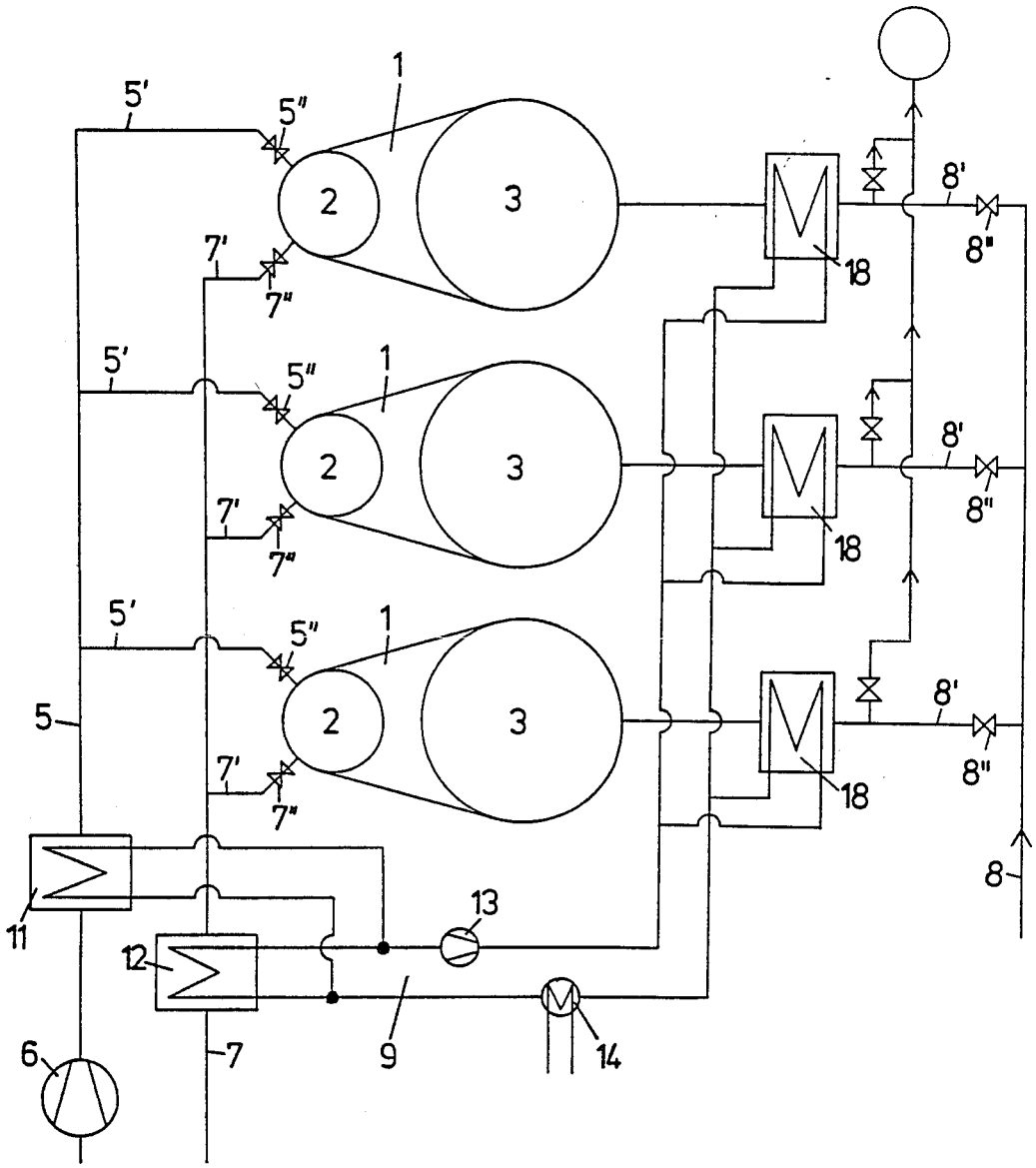
FIG. 4 is a view similar to FIG. 2 but illustrating a modification thereof employing a plurality of heat exchangers for removing heat from cold blast supplied to respective of the stoves.

FIG. 4 illustrates a further modification of the present invention. Thus, rather than the arrangement of FIG. 2 wherein in a single heat exchanger 10 is provided in cold blast main 8, in the arrangement of FIG. 4 there are provided individual heat exchangers 18 in each of the branch lines 8'. Heat exchangers 18 are connected in parallel to each other and to circuit 9. During a blowing phase of operation of a particular stove 1, with the respective valve 8'' open, cold blast is supplied through the respective branch line 8' and the respective heat exchanger 18. Heat exchanger 18 removes heat from such cold blast and transfers such heat to the heat exchange fluid in circuit 9. On the other hand, when such stove is operated during the heating phase thereof, with the respective valve 8'' closed, waste or exhaust gas is discharged from the stove and passes through the respective branch line 8' and respective heat exchanger 18 before being passed to the exhaust gas stack. Heat exchanger 18 thus removes heat from such waste gas and transfers such heat to the heat exchange fluid in circuit 9. Thus, in this embodiment of the present invention each heat exchanger 18 alternately is supplied with cold blast or waste gas and in both cases removes heat from such gases.

Although the present invention has been described and illustrated with respect to preferred features thereof, it is to be understood that various changes and modifications may be made to the specifically described and illustrated features without departing from the scope of the present invention.

We claim:

1. In a hot blast stove installation for heating cold blast to form hot blast and including a plurality of hot blast stoves each alternately operable during a heating phase and a blowing phase, and a cold blast main for supplying cold blast to respective said stoves during the blowing phases thereof, wherein said cold blast in said cold blast main has a relatively high temperature compared to ambient temperature, the improvement comprising:

means for reducing the temperature of said cold blast from said cold blast main prior to the supply thereof to said stoves.

2. The improvement claimed in claim 1, wherein said temperature of said cold blast, prior to cooling thereof by said cooling means, is from 100° C. to 300° C.

3. The improvement claimed in claim 1, wherein said cooling means comprises heat exchanger means connected to said cold blast main.

4. The improvement claimed in claim 3, further comprising a combustion air main and a fuel gas main for supplying combustion air and fuel gas to respective said stoves during said heating phases thereof, and said heat exchanger means includes means for delivering heat removed from said cold blast to at least one of said combustion air and said fuel gas.

5. The improvement claimed in claim 4, wherein said heat exchanger means delivers said heat directly to said at least one of said combustion air and said fuel gas.

6. The improvement claimed in claim 4, wherein said delivering means comprises a circuit leading from said heat exchanger means connected to said cold blast main to at least one heat exchanger connected to at least one of said combustion air main and said fuel gas main.

7. The improvement claimed in claim 6, further comprising supplemental heating means connected to said circuit for supplying supplemental heat thereto.

8. The improvement claimed in claim 7, further comprising means for discharging exhaust gas from said stoves during said heating phases thereof, and wherein said supplemental heating means comprises means for supplying heat from said exhaust gas to said circuit.

9. The improvement claimed in claim 8, wherein said supplemental heating means comprises a heat exchanger connected to said circuit, a further heat exchanger connected to said exhaust gas discharging means, and a second circuit connecting said heat exchanger connected to said circuit and said further heat exchanger.

10. The improvement claimed in claim 6, further comprising a plurality of branch lines from said cold blast main to respective said stoves, and said heat exchanger means comprises a plurality of heat exchangers each connected to a respective said branch line and to said circuit.

11. The improvement claimed in claim 10, wherein said plurality of heat exchangers are connected in parallel to each other.

12. The improvement claimed in claim 10, further comprising means for, during said heating phases of sad stoves, passing through respective said branch lines exhaust gases from said stoves, whereby said plurality of heat exchangers alternately are fed with cold blast and exhaust gas during blowing and heating phases, respectively, of said stoves.

* * * * *